United States Patent [19]

Kelley

[11] 4,393,751

[45] Jul. 19, 1983

[54] TWO HOLE HYDRAULIC CUSHION VALVE

[75] Inventor: Clarence R. Kelley, Mishawaka, Ind.

[73] Assignee: C. C. Kelley & Sons, Mishawaka, Ind.

[21] Appl. No.: 226,750

[22] Filed: Jan. 21, 1981

[51] Int. Cl.[3] ..... F15B 15/22

[52] U.S. Cl. ..... 91/408; 91/443

[58] Field of Search ..... 91/408, 409, 407, 406, 91/443; 137/513.3

[56] References Cited

U.S. PATENT DOCUMENTS

| | | | |
|---|---|---|---|
| 2,886,065 | 5/1959 | Hershman | 137/513.3 |
| 4,009,639 | 3/1977 | Saboshi | 91/408 |
| 4,089,251 | 5/1978 | Louviot | 91/408 |

FOREIGN PATENT DOCUMENTS

| | | | |
|---|---|---|---|
| 2372338 | 7/1978 | France | 91/408 |
| 158762 | 3/1964 | U.S.S.R. | 137/513.3 |

*Primary Examiner*—Paul E. Maslousky

*Attorney, Agent, or Firm*—James D. Hall

[57] ABSTRACT

A cushion valve for a hydraulic piston. The valve includes two inlet ports each connected into the same end of the cylinder. One port leads directly to an outlet while the second port feeds to the outlet through a floating, restricted flow orifice to provide a cushioning effect for the piston.

4 Claims, 4 Drawing Figures

TWO HOLE HYDRAULIC CUSHION VALVE

SUMMARY OF THE INVENTION

This invention relates to a valve which will have application for use with a hydraulic piston.

When utilizing a hydraulic piston, it is desirable to slow or cushion the speed of the piston as it approaches the end of its stroke within the cylinder. To offer a proper cushioning effect, prior inventions have used spring-urged check valves, adjustable valves and multiple reservoirs. The previous systems have had complexity and manual adjustment as drawbacks. A number of prior patents have used a two-hole system to exhaust fluid from the cylinder, as shown in U.S. Pat. Nos. 118,692; 19,119; 252,920; 855,266; 279,999; and 743,927. Each of these patents, however, uses the check valves and spring urged valves mentioned above.

The valve of this invention utilizes a two port inlet with one such port having a floating restrictive orifice. The cylinder which houses the hydraulically actuated piston has two outlets longitudinally oriented at the cylinder end. The valve has each outlet connected to a cylinder end outlet. As the piston passes the first cylinder end outlet, the port is sealed. The fluid ahead of the piston in the cylinder then exhausts through the second cylinder end outlet and into the valve inlet port with the restrictive flow orifice. This fluid flow through the valve flow orifice causes cushioning, stopping movement of the piston. Upon reverse movement of the piston, the valve orifice floats to a position to allow full flow of the fluid through the valve into the cylinder.

Accordingly, it is an object of this invention to provide a cushion valve for a hydraulic piston.

Another object is to provide a cushion valve with a floating orifice.

Still another object is to provide an economical and reliable cushion valve for a fluid actuated piston.

Other objects will become apparent upon a reading of the following description.

DESCRIPTION OF THE PREFERRED EMBODIMENT

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

Figure 4:
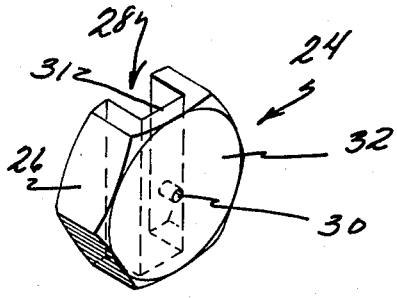
FIG. 4 is a perspective view of the floating orifice.

Referring to the drawings, valve 10 has a body 12 with a chamber 14 and a central passage 16 extending from one end of the chamber formed therein. A passage 19 leads into the bottom of chamber 14 at the opposite end 15 of the chamber from passage 16. A passage 18 leads into central passage 16. Central passage 16 is connected to a nipple 22 defining outlet port 20. Located within chamber 14 is a floating restrictive orifice part 24. Floating orifice part 24, as shown in FIG. 4 as a polygonal body 26 with a transverse channel 28 formed in its one face 31. A hole 30 extends from face 31 at channel 28 to face 32 through body 26.

A reciprocating piston 38 is housed within a cylinder 34 (shown in fragmented form). An actuator rod 39 is carried by piston 38. Hydraulic fluid is introduced into and evacuated from each end of cylinder 34 to cause piston 38 to move from one end to the other of the cylinder. At each end of cylinder 34 is a pair of longitudinally aligned ports 42, 43. A valve 10 is preferably attached at each end of cylinder 34. Valve passage 18 is placed in communication with cylinder port 42 by connector 36. Valve passage 19 is placed in communication with cylinder port 43 by a connector 36.

Figure 1:
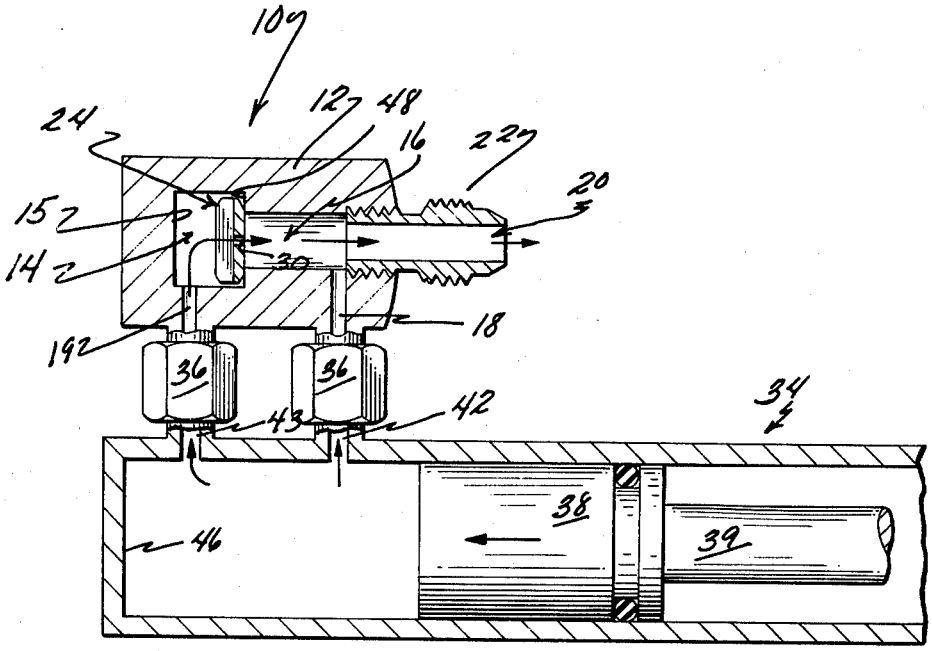
FIG. 1 is a fragmentary cross-sectional view of a hydraulic piston and cylinder assembly with the cushion valve of this invention.
Figure 2:
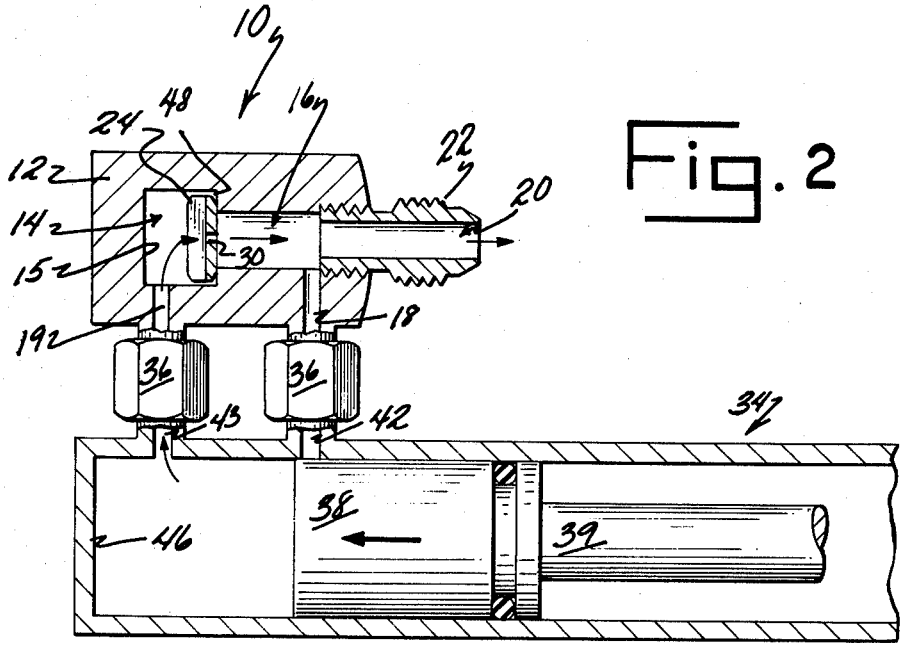
FIG. 2 is a fragmentary cross-sectional view of the assembly of FIG. 1 with the piston sealing one port in the cylinder.
Figure 3:
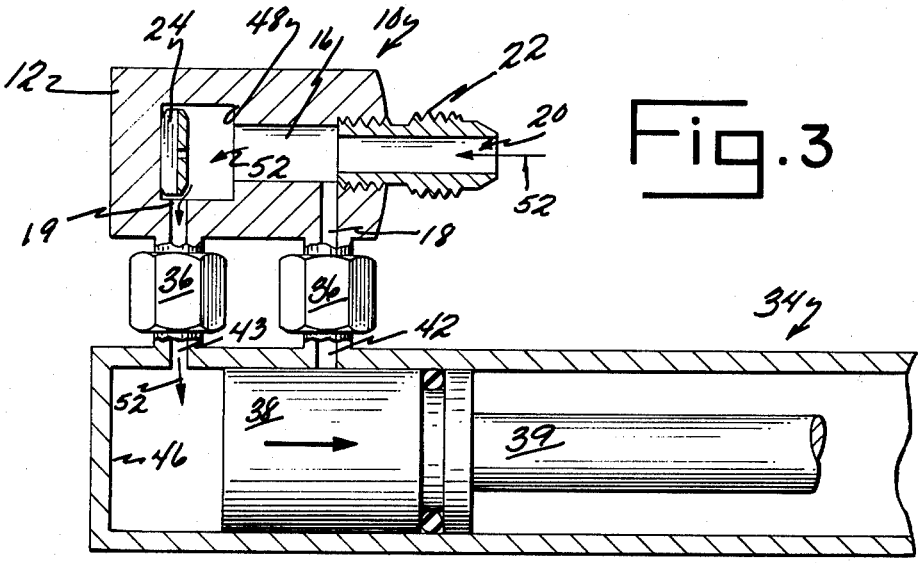
FIG. 3 is a fragmentary cross-sectional view of the assembly with the piston moving opposite the direction shown in FIG. 1.

FIGS. 1–3 are sequentially illustrative of a cycle as piston 38 travels down cylinder 34 toward its end wall 46 and then reverses movement. The movement of piston 38 toward end wall 46 forces hydraulic fluid through ports 42, 43 into valve passages 18, 19 and out port 20 as seen in FIG. 1. Upon entering chamber 14, fluid passes between orifice part 24 at channel 28 and end 15 of chamber 14, thereby moving the orifice part 24 to abut chamber wall 48, fluid can essentially only enter central passage 16 from valve port 19 through hole 30 in the orifice part.

With piston 38 in the position shown in FIG. 1, the piston actuator fluid can exhaust through both cylinder ports 42, 43. As piston 38 passes port 42, as illustrated in FIG. 2, the actuator fluid can exhaust only through cylinder port 43. During this time orifice part 24, as it abuts chamber wall 48, restricts the flow of fluid from cylinder 34, thereby cushioning the thrust of piston 38 as it nears the end of its stroke.

Arrows 52 in FIG. 3 illustrate the flow of hydraulic fluid during initial reverse movement of piston 38. The fluid is pumped through valve 10 with the force of the fluid urging orifice part 24 from abutment with chamber wall 48 and back against chamber end 15. With orifice part 24 forced against chamber end 15, the fluid can then flow generally unrestricted around the orifice part, into passage 19, and into the cylinder behind piston 38. After piston 38 clears cylinder port 42, fluid will enter cylinder 14 through both ports 42, 43.

While the fluid for actuating piston 38 has been described as hydraulic, it is to be understood that air or other fluid could be used.

It is understood that the invention is not to be limited to the preceding description but may be modified within the scope of the appended claims.

What I claim is:

1. In a cylinder having a fluid actuated piston therein, said piston being shiftable longitudinally within said cylinder by the operation of said fluid, the improvement wherein said cylinder includes two ports at one end for evacuating fluid from in front of said piston as it is urged toward said one cylinder end and for introducing fluid at the rear of said piston to urge it away from said one cylinder end, said cylinder ports being spaced longitudinally apart along the direction of travel of said piston within said cylinder with one port nearer said cylinder end than the other port, said piston being shiftable over said other cylinder port, a valve for evacuating and introducing fluid from and into said one cylinder end, said valve having first, second and third passages, each of said first and second passages in spaced communication with said third passage in the valve, a fluid flow restrictor means within said third valve passage and shiftable therein in response to fluid flow from a non-operative position to an operative position between said first and second passages for reducing the rate of fluid flow from said first valve passage into said third valve passage, said first valve passage in communication with said one cylinder port, said second valve passage in communication with said other cylinder port whereby fluid will first flow through both said first and second valve passages and out said third valve passage as the piston approaches said one cylinder end and then flow only through said first and third valve passages at a reduced rate after said piston shifts over said other cylinder port to provide a cushioning resistance to the movement of said piston.

2. The cylinder of claim 1 wherein said restrictor means is shiftable within said third passage between said operative and non-operative positions in response to the direction of fluid flow through the valve, said restrictive means being in its operative flow reducing position upon fluid flow from said first to said third valve passage and being in its non-operative position upon fluid flow from said third to said first valve passage.

3. The cushion valve of claim 1 wherein said restrictor means is a polygonal plate with an orifice formed therethrough.

4. The cushion valve of claim 3 wherein said restrictor means is defined by a first and second face and lateral edge, one of said faces having diametrical channel means formed therein for causing said restrictor means to shift from its non-operative position to its operative position in response to fluid flow from said first valve passage into said third valve passage, said orifice extending from said channel through said plate to said other face.

* * * * *